US009217627B2

(12) United States Patent
Sullivan et al.

(10) Patent No.: US 9,217,627 B2
(45) Date of Patent: Dec. 22, 2015

(54) TRAINING AMMUNITION CARTRIDGE WITH REACTIVE LIQUID MATERIALS FOR MARKING A POINT OF IMPACT

(71) Applicant: KMS CONSULTING, LLC, Kennebunk, ME (US)

(72) Inventors: Kevin Michael Sullivan, Kennebunk, ME (US); Marcelo Eduardo Martinez, Cordoba (AR)

(73) Assignee: KMS CONSULTING, LLC, Kennebunk, ME (US)

( * ) Notice: Subject to any disclaimer, the term of this patent is extended or adjusted under 35 U.S.C. 154(b) by 149 days.

(21) Appl. No.: 14/215,253

(22) Filed: Mar. 17, 2014

(65) Prior Publication Data

US 2015/0268018 A1 Sep. 24, 2015

Related U.S. Application Data

(60) Provisional application No. 61/803,827, filed on Mar. 21, 2013.

(51) Int. Cl.

| | |
|---|---|
| ***F42B 10/00*** | (2006.01) |
| ***F42B 12/40*** | (2006.01) |
| ***F42B 8/12*** | (2006.01) |

(52) U.S. Cl.
CPC .. *F42B 12/40* (2013.01); *F42B 8/12* (2013.01)

(58) Field of Classification Search
CPC ..... F42B 12/40; F42B 8/12
See application file for complete search history.

(56) References Cited

U.S. PATENT DOCUMENTS

| | | | | |
|---|---|---|---|---|
| 3,234,877 | A * | 2/1966 | Herter | F42B 7/08 102/451 |
| 3,515,070 | A | 6/1970 | Cutler et al. | |
| 3,528,662 | A | 9/1970 | Merchant | |
| 3,539,794 | A | 11/1970 | Rauhut et al. | |
| 3,565,010 | A * | 2/1971 | Sahlmann | F42B 7/08 102/451 |
| 3,625,155 | A | 12/1971 | Douda et al. | |
| 3,788,224 | A * | 1/1974 | Merritt | F42B 7/08 102/450 |
| 3,811,381 | A | 5/1974 | Fichter, Jr. et al. | |
| 3,865,038 | A | 2/1975 | Barr | |
| 3,911,824 | A | 10/1975 | Barr et al. | |
| 3,938,817 | A | 2/1976 | Rohm | |
| 4,128,059 | A | 12/1978 | Black | |
| 4,505,200 | A | 3/1985 | Bush | |
| 4,686,905 | A * | 8/1987 | Szabo | F42B 5/02 102/444 |
| 4,915,028 | A | 4/1990 | Apotheloz | |

(Continued)

FOREIGN PATENT DOCUMENTS

| | | |
|---|---|---|
| WO | 2010078426 A1 | 7/2010 |
| WO | 2012036632 A1 | 3/2012 |

(Continued)

*Primary Examiner* — Samir Abdosh
(74) *Attorney, Agent, or Firm* — Karl F. Milde, Jr.; Eckert Seamans Cherin & Mellott, LLC

(57) ABSTRACT

A practice ammunition projectile has a projectile head with one or more sheets of plastic material, each having a plurality of frangible "bubble shaped" compartments containing liquid chemical components for optical and/or Infrared marking of a target upon impact. The sheets are preferably flexible sheets in the nature of a "bubble wrap" of the type used as padding for packaging. These so-called "matrix packages" are installed adjacent the inner surface of the shell forming the projectile head and provide stability when the compartments break up upon setback when the projectile is fired from a weapon.

8 Claims, 5 Drawing Sheets

(56) References Cited

U.S. PATENT DOCUMENTS

| | | | |
|---|---|---|---|
| 5,009,164 | A | 4/1991 | Grinberg |
| 5,018,449 | A | 5/1991 | Eidson |
| 5,035,183 | A | 7/1991 | Luxton |
| 5,238,610 | A | 8/1993 | Thompson |
| 5,281,367 | A | 1/1994 | Schleck et al. |
| 5,298,197 | A | 3/1994 | Thompson |
| 5,348,690 | A | 9/1994 | Cohen et al. |
| 5,488,544 | A | 1/1996 | Ladyjensky |
| 5,508,893 | A | 4/1996 | Nowak et al. |
| 5,552,968 | A | 9/1996 | Ladyjensky |
| 5,661,257 | A | 8/1997 | Nielson |
| 6,158,348 | A | 12/2000 | Campoli |
| 6,269,747 | B1 | 8/2001 | Strandli |
| 6,279,482 | B1 | 8/2001 | Smith et al. |
| 6,497,181 | B1 | 12/2002 | Manole et al. |
| 6,543,365 | B1 | 4/2003 | Vasel et al. |
| 6,619,211 | B1 | 9/2003 | Haeselich |
| 6,871,593 | B2 | 3/2005 | Knopf et al. |
| 6,990,905 | B1 | 1/2006 | Manole et al. |
| 7,055,438 | B1 | 6/2006 | Manole et al. |
| 7,331,293 | B2 | 2/2008 | Saxby |
| RE40,482 | E | 9/2008 | Haeselich |
| 7,487,728 | B2 | 2/2009 | Cranor |
| 7,793,591 | B1 | 9/2010 | Van Stratum |
| 7,964,119 | B2 | 6/2011 | Bindra et al. |
| 8,297,187 | B2 | 10/2012 | Sullivan |
| 8,424,456 | B2 | 4/2013 | Broden et al. |
| 8,438,978 | B2 | 5/2013 | Sullivan et al. |
| 8,443,732 | B2 | 5/2013 | Sullivan |
| 8,485,102 | B2 | 7/2013 | Carlson et al. |
| 8,505,456 | B2 | 8/2013 | Haeselich |
| 8,584,590 | B2 | 11/2013 | Cranor et al. |
| 8,584,591 | B2 | 11/2013 | Cranor et al. |
| 8,640,621 | B2 | 2/2014 | Broden et al. |
| 8,919,255 | B1 * | 12/2014 | Quintana ..... F42B 12/38 102/449 |
| 2007/0119329 | A1 | 5/2007 | Haeselich |
| 2011/0017091 | A1 | 1/2011 | Cranor et al. |
| 2012/0020050 | A1 | 1/2012 | Longo |
| 2012/0227614 | A1 | 9/2012 | Sullivan |

FOREIGN PATENT DOCUMENTS

| | | | |
|---|---|---|---|
| WO | 2012037533 | A1 | 3/2012 |
| WO | 2012054562 | A1 | 4/2012 |

* cited by examiner

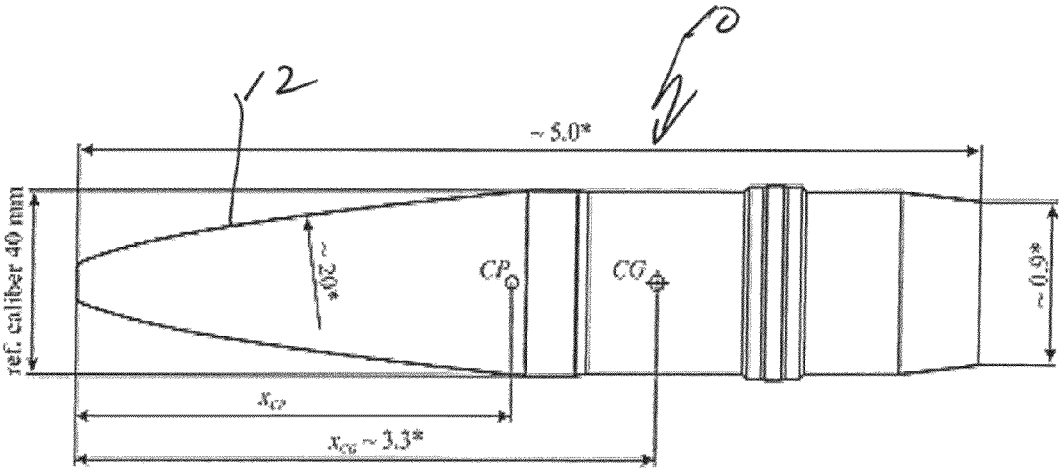
* relative dimensions as the number of calibers
Fig. 1. *Model of spin stabilized projectile*

TRAINING AMMUNITION CARTRIDGE WITH REACTIVE LIQUID MATERIALS FOR MARKING A POINT OF IMPACT

CROSS-REFERENCE TO RELATED APPLICATION

This application claims priority from Provisional Patent Application No. 61/803,827, filed Mar. 21, 2013.

BACKGROUND OF THE INVENTION

The present invention relates to the field of training ammunition and, more specifically, to a non-pyrotechnic training ammunition cartridge having a projectile that can mark its point of impact both by day and by night.

Military gunners often fire their weapons at long range in military training areas that include grass, vegetation and low lying trees. Hence, while there is some value in firing projectiles that directly mark a target on impact, the morphology and terrain on a military range frequently preclude gunners from having direct views of the actual impact points.

Good military training devices should simulate the effects of live fire high-explosive detonations. In combat such detonations generate visual and near infra-red light and heat, forming a multi-spectral signature. High explosive detonations also produce smoke plumes. The light and heat resulting from high-explosive detonations can be detected by an array of fire control devices used by the military. The smoke plumes are also visible to the naked eye.

The target locating devices used in the military have visual cameras and cameras that operate in the near and/or far IR spectrum. Accordingly it is desired that practice ammunition simulate the effects seen in combat and that practice ammunition generate multi-spectral marking signatures, upon impact, that can be viewed by these cameras.

Currently, military forces use a wide array of technologies to detect and identify targets and adjust fire. Traditionally, they have used pyrotechnic devices in training ammunition allowing gunners to trace their fire and mark their targets. These pyrotechnic devices produce smoke and heat plumes from combustion of pyrotechnic compounds. Unfortunately, these pyrotechnic devices frequently generate dangerous unexploded ordnance (UXO) and pyrotechnic compounds frequently have chemicals that contaminate ground water. Ground water contamination and UXO are expensive to remediate. Additionally, pyrotechnic devices can also start range fires, leading to destruction of ecosystems and soil erosion.

To prevent the generation of UXO and range fires during training, inert practice ammunition cartridges have been developed which do not employ energetic pyrotechnics to trace the flight and mark the impact of the projectile. For example, low density, dry fine powders have been used to create a plume for visibly marking the target upon impact. This marking agent has been used, for example, in the US Army's M781 40 mm low velocity cartridge.

Chemi-luminescent technology, such as that taught in the U.S. Pat. No. 6,619,211, has also been used to mark both the trace and point of impact by night. Two liquid chemical components are placed in separate frangible compartments or ampoules that break open on setback when the projectile is fired from a weapon. This allows the components to mix and luminesce, thereby providing a visible trace during flight if the projectile ogive is transparent or translucent, and marking the point of impact when the projectile strikes the target. As disclosed in this patent, the frangible ampoules are located near center of a projectile's axis of rotation and, when the liquids are released from their compartments, they tend to destabilize the projectile as it spins, resulting in projectile yaw.

The U.S. Pat. No. 8,438,978 discloses a multi-spectral marking projectile having chemical components that are caused to mix upon setback, due to the initial acceleration and the centrifugal forces, and thereby produce an exothermic reaction which emits heat during the flight of the projectile. This serves to warm the chemi-luminescent materials during flight and provides an Infrared marking signature when the projectile strikes the target.

The U.S. Pat. No. 7,055,438 also discloses a flameless tracer/marker utilizing heat marking chemicals in addition to chemo-luminescent materials.

The subject matter of the various patents noted above is incorporated herein by reference.

SUMMARY OF THE INVENTION

The principal objective of the present invention is to provide a non-pyrotechnic ammunition projectile that provides a visual effect upon impact that closely stimulates the effects of live fire detonations: marking signatures that may be seen by day and detected by military night vision and thermal sensors by night.

A further objective of the present invention is to provide a training projectile of the type described above having a configuration that can be manufactured at a reasonable cost.

A still further objective of the present invention is to provide a training projectile of this type which carries reactive liquid components, such as chemi-luminescent or exothermic materials, yet is configured to remain stable in flight and does not suffer from instability generally resulting from on-board liquids.

A still further objective of the present invention is to provide a training projectile of this type which carries a fine dry powder as marking agent in the projectile head which bursts open upon impact and creates a powder plume for visibly marking the target.

These objects, as well as other objects which will become apparent from the discussion that follows, are achieved according to the present invention, by providing the projectile with one or more sheets of material, each having a plurality of frangible "bubble shaped" compartments containing liquid chemical components for optical and/or Infrared marking. The sheets are preferably flexible or conformal sheets of plastic material in the nature of a "bubble wrap" of the type used as padding for packaging. These so-called "matrix packages" are installed in a compartment formed by the head of the projectile body adjacent the inner surface of the compartment wall. The "bubbles" formed in the sheets which contain the chemical components are designed to break upon impact, releasing the components and allowing them to mix and chemically react. The components may of the type that create chemi-luminescence to create light, or they may be of the type that mixes create heat. Multiple components may be provided to create both light and heat.

Advantageously, two or more separate sheets are arranged in an adjacent concentric configuration leaving an open space in the center of the projectile head. This space may be either left empty or, in a preferred embodiment of the invention, filled with a fine dry powder marking agent that is released and forms a plume when the projectile head breaks open upon impact.

For a full understanding of the present invention, reference should now be made to the following detailed description of the preferred embodiments of the invention as illustrated in the accompanying drawings.

BRIEF DESCRIPTION OF THE DRAWINGS

FIG. 1 is a side view of a spin stabilized 40 mm projectile of the type to which the present invention relates.

DETAILED DESCRIPTION OF THE PREFERRED EMBODIMENTS

Figure 2A:
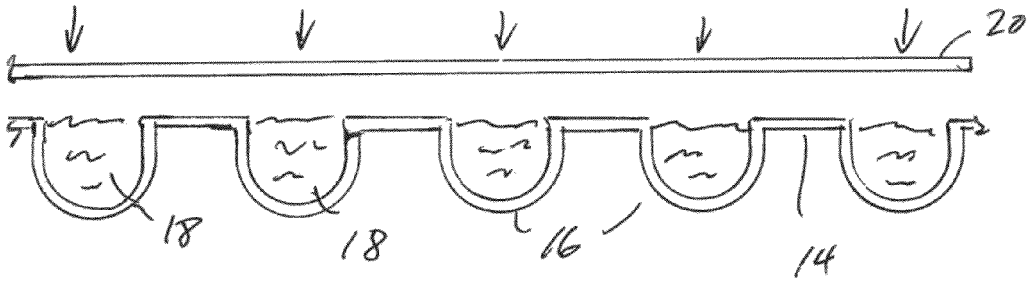
FIGS. 2A, 2B and 2C are representative diagrams, not to scale, showing the method of making a flexible and frangible bubble wrap sheet according to the invention, with bubbles filled with a liquid.

The preferred embodiments of the present invention will now be described with reference to FIGS. 1-6 of the drawings. Identical elements in the various figures are designated with the same reference numerals.

The present invention concerns a projectile with a frangible head that can be configured in multiple calibers (with differing trajectories, spin rates, etc.). Upon impact, the ogive (head) breaks open and releases both day and night marking agents.

While most of projectiles in use today behave as rigid bodies while in flight, more and more projectiles are designed to carry a liquid or non-rigid payload. Some examples of such are (1) artillery rounds that generate smoke and comprise a spin stabilized shell with a canister filled with white phosphorous; (2) marking projectiles with liquid chemical components that mix upon impact to generate specific signatures in a broad range of radiation bands; (3) leas-than-lethal projectiles having a liquid with aggressive chemicals or marking paint; and (4) projectiles that carry medical supplies (e.g., intravenous fluid bags).

There can be a significant difference in flight behavior between liquid-filled and solid-filled projectiles. The difference is due to motion of the liquid inside the spinning projectile during flight. This motion causes forces to act on the projectile body that disrupt the spin and can prematurely terminate the flight by instability. Characteristics of this instability are sharp increases in the angle of attack (AOA) accompanied by large changes in spin rate. When launched, the motion of the projectile causes the fluid to spin up in a time-dependent manner, although it may subsequently achieve steady state.

According to the invention, the liquid chemical components in the projectile are contained in a matrix of frangible "bubbles" or ampoules formed in a sheet of material, layered adjacent to the inner surface of the projectile body. This "matrix packaging" configuration minimizes the problematic movement of unstable moments, inertia, friction and resonances generated by a liquid, all of which can disturb the flight characteristics of the projectile.

The bubbles or ampoules in the bubble wrap sheet according to the invention are designed break upon impact when the projectile strikes the ground or a target, allowing the constituent chemical materials to mix and react together.

Upon impact, the head of the projectile (ogive) breaks apart generally releasing the reacting chemicals into the atmosphere, forming a visual and IR signature visible at night or through near IR night vision devices.

Maintaining the liquid chemical materials close to the inner surface of the outer wall of the ogive provides for good ballistic stability of the projectile because its center of gravity does not shift during flight. This configuration is not able to change the spin rate, since the liquid will neither rotate nor oscillate in inertial waves, hence having no chance to influence the so-called "spin decay", typical of a liquid payload with free liquid in a full container.

It should be noted that the "bubble wrap" packing must be carefully designed to avoid "eigenvalue" resonance. Also both sheet layers must be properly contained so that they cannot move or be deformed during setback and in flight.

Having these issues in mind, it may be seen that packing the liquid materials in "bubble wrap" layers improves the flight behavior of marking projectiles. This applies also to other types of non-rigid payload projectiles such as non-lethal projectiles that carry liquid components.

FIG. 1 shows a 40 mm projectile 10 of the type to which the present invention relates. The various dimensions of the projectile are indicated, relative to the number of calibers. The projectile has an ogive 12 that carries one or more marking agents, including liquid chemical materials which react when missed. These liquids are contained and constrained in a matrix package of bubble wrap sheets, as will be explained below, which maintains the stability of the projectile in flight.

Figure 2B:
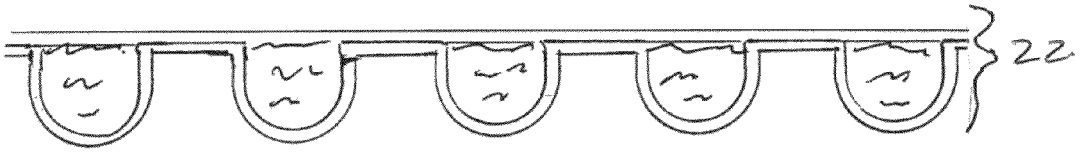
Figure 2C:
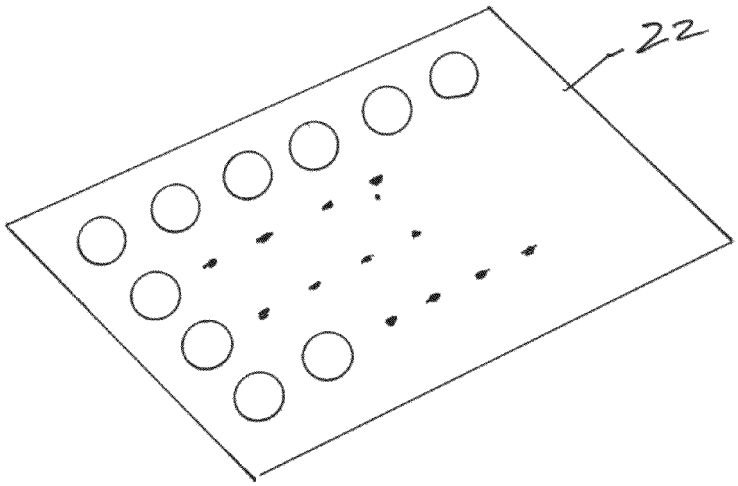

The bubble wrap sheet according to the invention is illustrated in FIGS. 2A, 2B and 2C. FIG. 2A shows a plastic sheet 14 containing depressions or "bubbles" 16 filled with a liquid 18. Once filled, a cover sheet 20 is applied and heat-sealed to the sheet 14 to form a composite sheet 22. This composite sheet is shown in perspective in FIG. 2C.

Figure 3:
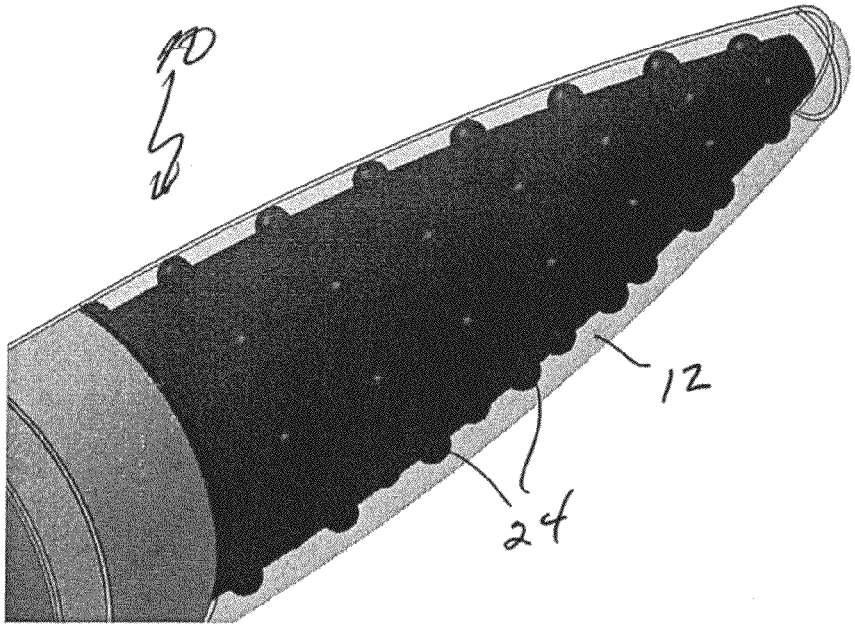
FIG. 3 is a cutaway view of the head of the projectile of FIG. 1, showing the compartment wall with indentations designed to accommodate bubbles of a bubble wrap sheet.

FIG. 3 shows the interior of the head (ogive) 12 of the projectile 10 without the "bubble wrap" sheets according to the invention that contain the reactive liquid chemical materials. The wall of the ogive 12 is formed of a plastic or composite material or of a thin-walled metal. The inner surface of the wall is provided with small indentations to receive the bubbles of the bubble wrap sheets 22.

Figure 4:
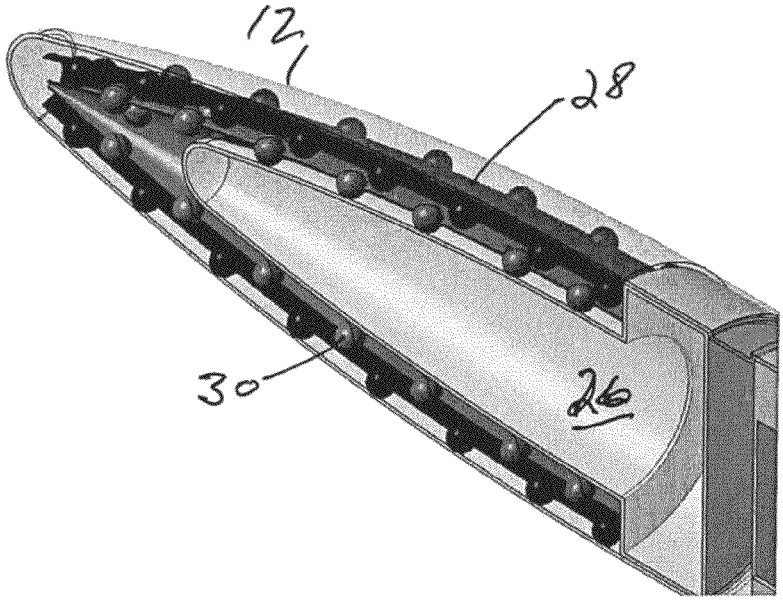
FIG. 4 is a view of the projectile head shown in FIG. 3 with the frangible bubble wrap sheets according to the invention, which contain liquid chemical materials, arranged adjacent the compartment wall.
Figure 5:
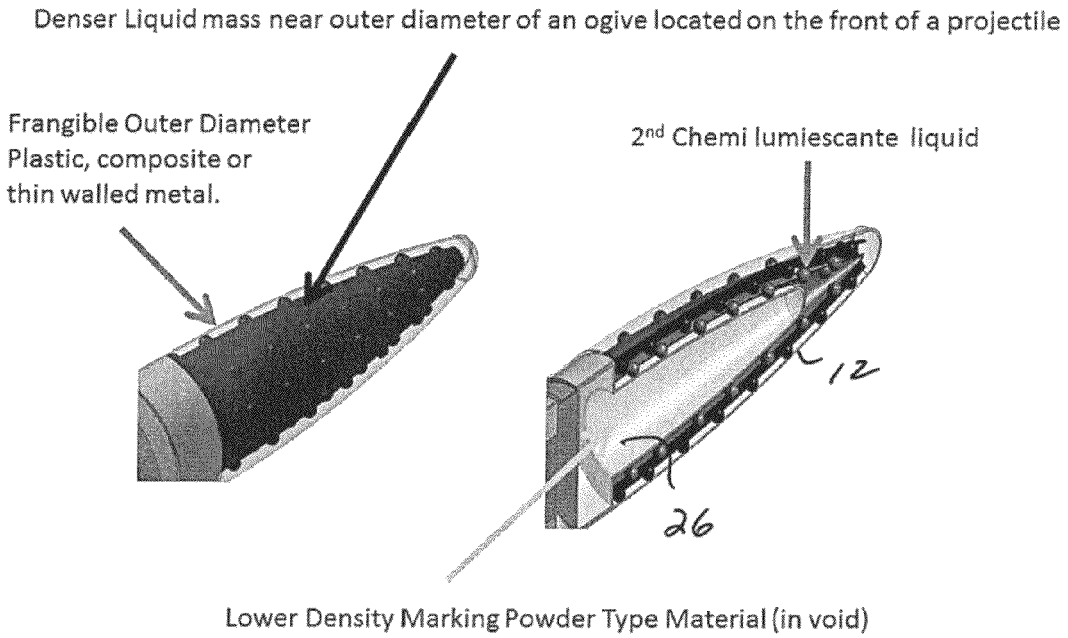
FIG. 5 is an composite view of the projectile heads shown in FIGS. 3 and 4 with two "bubble wrap" sheets containing a reactive liquid chemi-luminescent in each and a fine dry powder contained in a compartment inside the bubble wrap sheets.

The wall of the ogive 12 is designed to break up upon impact and release its contents. Internal to the ogive 12 is a space filled by a shaped container 26 surrounded by two "bubble wrap" sheets 28 and 30 having frangible bubbles filled with various liquid chemical materials, as is shown in FIGS. 4 and 5. If the ogive is relatively long, the liquid mass contained in the bubbles is preferentially located near the front of the projectile.

As noted above, the bubbles are designed to break open upon impact with the target, releasing the materials and allowing them to mix end react chemically together. If the materials are chemi-luminescent components they will luminesce; if they are exothermic components they will create heat. Both types of components may be provided either in separate compartments or in a common compartment in the projectile.

The container 26 in the center of the ogive 12 advantageously contains a dyed fine dry powder that is released upon impact for visual (day) marking.

Figure 6:
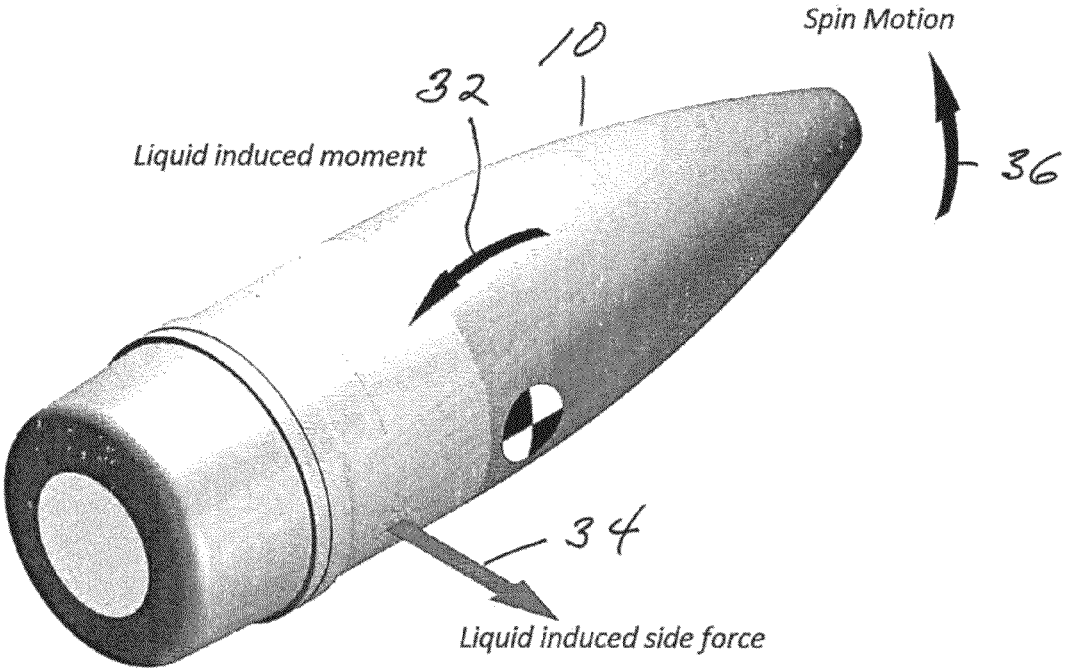
FIG. 6 is perspective view of the projectile of FIG. 1 showing the spin moments and forces that would occur without use of the bubble wrap sheets according to the invention.

As is illustrated in FIG. 6, a projectile 10 containing a liquid is subject to a number of liquid-induced forces 32, 34 and 36 which can make it unstable in flight. The use of the bubble wrap package according to the invention, located adjacent the outer wall of the projectile, minimizes (1) the coefficient induced side force, (2) the moment force, and (3) the destabilizing resonances when liquids are contained in the bubbles. This design minimizes spin decay and optimizes gyroscopic stability of a projectile containing the reactive liquid chemical mix that functions on impact.

There has thus been shown and described a novel training ammunition cartridge with reactive liquid materials for marking a point of impact which achieves all of the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A practice ammunition cartridge comprising a hollow projectile and a cartridge case with a propellant charge, the projectile having a hollow projectile head designed to withstand the forces applied when the projectile is fired from a weapon and designed to burst when the projectile strikes a target; wherein a liquid marking agent is disposed in the head for marking the impact with the target after the head has burst; wherein said marking agent includes a plurality of liquid chemical components each received in a separate frangible compartment in the head, said components being mixed with each other when the compartments break up, causing the mixed components to react chemically; wherein the compartments are designed to be broken up by impact or rapid deacceleration; and wherein the compartments comprise numerous individual small frangible ampoules that are formed as bubbles in a sheet of plastic material arranged adjacent and parallel to an inner wall of the projectile head.

2. The training ammunition cartridge as defined in claim 1, wherein the chemical components comprise first and second chemi-luminescent components which luminesce when mixed upon impact, optically marking a target; and wherein the first component is disposed in a plurality of ampoules formed in a first plastic sheet and the second component is disposed in a plurality of ampoules formed in a second plastic sheet, said first and second sheets being adjacently arranged in the head of the projectile.

3. The training ammunition cartridge as defined in claim 2, wherein the first and second sheets are concentrically arranged.

4. The training ammunition cartridge as defined in claim 2, wherein the chemi-luminescent components, when mixed, emit light in at least one of the visible and infrared ranges.

5. The training ammunition cartridge as defined in claim 1, wherein the chemical components comprise first and second exothermic components which create heat when mixed for marking a target, and wherein the first component is disposed in a plurality of ampoules formed in a first plastic sheet and the second component is disposed in a plurality of ampoules formed in a second plastic sheet, said first and second sheets being adjacently arranged in the head of the projectile.

6. The training ammunition cartridge as defined in claim 5, wherein the first and second sheets are concentrically arranged.

7. The training ammunition cartridge as defined in claim 5, wherein the exothermic components, when mixed, emit radiation in the infrared range.

8. The training ammunition cartridge as defined in claim 1, wherein said projectile further comprises a central compartment, arranged along a central longitudinal axis of the projectile, and a dry powder marking agent is disposed in said central compartment, whereby the marking agent is released and forms a powder plume when the projectile strikes the target.

* * * * *